US006976926B2

(12) United States Patent
LaPointe

(10) Patent No.: US 6,976,926 B2
(45) Date of Patent: Dec. 20, 2005

(54) EXTENDED-USE BALL STRIKING TRAINING DEVICE

(75) Inventor: Richard LaPointe, San Diego, CA (US)

(73) Assignee: Pro Performance Sports, LLC, San Diego, CA (US)

( * ) Notice: Subject to any disclaimer, the term of this patent is extended or adjusted under 35 U.S.C. 154(b) by 0 days.

(21) Appl. No.: 10/756,162

(22) Filed: Jan. 12, 2004

(65) Prior Publication Data

US 2005/0153795 A1 Jul. 14, 2005

(51) Int. Cl.[7] ..... A63B 69/00

(52) U.S. Cl. ..... 473/429; 473/428; 473/422; 473/575

(58) Field of Search ..... 473/429, 415, 473/426–428, 422–424; D21/780; 482/120–124; 273/331–335

(56) References Cited

U.S. PATENT DOCUMENTS

| | | | | |
|---|---|---|---|---|
| 1,554,409 A | | 9/1925 | Coffee | |
| 2,842,366 A | | 7/1958 | Fant | |
| 3,006,647 A | | 10/1961 | Haskett | |
| 3,143,351 A | | 8/1964 | Bertrand | |
| 3,166,316 A | | 1/1965 | O'Leary | |
| 3,397,885 A | | 8/1968 | Nash, Jr. | |
| 3,550,937 A | * | 12/1970 | Patterson et al. | 473/428 |
| 3,630,521 A | | 12/1971 | Lingbeek et al. | |
| 3,637,209 A | * | 1/1972 | Raut | 473/424 |
| 3,703,286 A | | 11/1972 | Adkin | |
| 3,940,133 A | | 2/1976 | Civita | |
| 3,994,494 A | | 11/1976 | Kelley | |
| 4,322,075 A | | 3/1982 | Hynes | |
| 4,415,155 A | | 11/1983 | Goudreau et al. | |
| 4,460,172 A | | 7/1984 | Hogan | |
| 4,664,375 A | | 5/1987 | Tetreault | |
| 4,815,735 A | | 3/1989 | McClenny | |
| 4,898,385 A | | 2/1990 | Love | |
| 4,966,367 A | | 10/1990 | Oyarzabal | |
| 5,040,791 A | | 8/1991 | Ratajac et al. | |
| 5,048,828 A | | 9/1991 | Love | |
| 5,083,796 A | | 1/1992 | Norman | |
| 5,135,219 A | | 8/1992 | McKeon et al. | |
| 5,244,392 A | | 9/1993 | Maursetter | |
| 5,250,016 A | * | 10/1993 | Higgins | 482/121 |
| 5,340,101 A | | 8/1994 | Lawson et al. | |
| 5,460,380 A | | 10/1995 | Ober | |
| 5,553,848 A | | 9/1996 | Amron | |
| 5,597,159 A | | 1/1997 | Haygood et al. | |

(Continued)

OTHER PUBLICATIONS

Web page downloaded May 9, 2005, Sep. 2003, www.bairstow.com/wrope5.htm, 2 pages.*
U-BAT-IT Hit Training Device. Markwort 1997.

*Primary Examiner*—Gregory Vidovich
*Assistant Examiner*—M. Chambers
(74) *Attorney, Agent, or Firm*—Gordon & Rees LLP

(57) ABSTRACT

A ball striking practice device is described in which a ball tethered to a pole can be struck by a player with a bat or racquet and will wrap around the pole and resile outwardly where it can be struck again. The device's service life is improved by providing a flat triangular ball positioner while aligns the tether cord in straight lines to pole attachment points, forming the cord from a flexible metal strand, preferably sheathed, constructing the positioner from an elastomeric or fabric web material, and seating the cord in a recess or insert in the ball. The device is excellent for batting or kicking practice in sports such as baseball, softball, soccer, tennis, squash and handball.

31 Claims, 3 Drawing Sheets

U.S. PATENT DOCUMENTS 5,601,286 A * 2/1997 Fierbaugh ..... 473/429
5,618,039 A * 4/1997 Tsai et al. ..... 473/423
5,683,315 A 11/1997 Ring
5,713,805 A * 2/1998 Scher et al. ..... 473/426
5,766,102 A 6/1998 Lawson et al.
5,778,017 A 7/1998 Brawn
5,797,810 A 8/1998 Sandoval
5,816,945 A 10/1998 Todd
5,882,270 A 3/1999 Daugherty
6,033,323 A 3/2000 McCown
6,142,889 A * 11/2000 Schaubach ..... 473/426
6,296,582 B1 10/2001 Minniear
6,514,161 B1 * 2/2003 Minniear ..... 473/428
6,716,119 B1 * 4/2004 Weisz et al. ..... 473/423

* cited by examiner

EXTENDED-USE BALL STRIKING TRAINING DEVICE

BACKGROUND OF THE INVENTION

1. Field of Invention

The invention relates to sports equipment, and more particularly to equipment that enables a player to practice striking a ball in a manner similar to actual play of a game.

2. Background Information

In many sports the object is to kick, hit or otherwise strike a ball. The skill of the player in such sports is usually directly related to the player's ability to efficiently and repeatedly strike the ball accurately and with appropriate force. To do this well requires extensive and repeated practice. When a player wishes to practice, however, he or she often finds that it is inconvenient or difficult to recruit another person to throw or otherwise deliver the ball so that the player can practice his or her hitting or kicking. To that end a number of different devices have been developed to enable a single person to practice hitting or kicking without the assistance of any other person. Typical such devices are described and claimed in prior U.S. Pat. Nos. 6,296,582 and 6,514,161.

The more significant of these device is of the type shown in the U.S. Pat. No. 6,514,161 patent in which the ball is tethered to a single vertical pole with the tethers being located at a height appropriate for hitting the ball with a bat as in baseball or softball or swatting the ball with a racquet as in tennis, handball or squash or at a height appropriate for use for kicking the ball as in soccer. For brevity herein, the present invention will usually be described in the embodiment appropriate for baseball or softball batting practice, and will be referred to as a "batting" practice device. It will be understood, however, that this description is for convenience only, and is not limiting, such that the device may be used for practice for a wide variety of various ball striking games, whether the ball is batted, kicked, swatted or struck with a player's hand.

It has been found that with the prior art batting devices, including those shown in the two patents identified above, the service life of the tether and ball portion of the device is often unduly shortened by fraying and breaking of the tether cord, particularly where it is joined to the ball positioner. It has also been found that when the ball it is misstrike additional stresses are placed on the tether cord and on the ball positioner such that the wear on the tether cord is increased. It will be recognized that this is a serious problem since misstriking of the ball occurs quite frequently, as one would expect for a device whose purpose is to allow inexperienced and less experienced batters practice their batting strokes in order to be able to improve their batting skills. When the batting devices are in almost constant use for prolonged periods, as is common for equipment owned and used by sports teams such as school and amateur baseball or softball teams, the misstriking of the ball plus the stresses inherently arising at the connection between the ball positioner and the tether can easily result in the tether portion of the batting device having to be replaced at frequent intervals.

It would therefore be of significant value if the ball striking device could be improved to reduce the stresses on the tether that arise not only from repeated normal use but also from the effects of the ball being repeatedly misstrike, so that the service life of each individual tether unit could be substantially increased.

SUMMARY OF THE INVENTION

The present invention is of an improved ball striking practice device or apparatus, in which a ball tethered to a pole can be struck by a player with a bat or racquet or can be kicked by the player, and by virtue of being tethered will spiral rapidly into the pole and then the tether will resile in an outward spiral, bringing the ball rapidly back to its previous radially outward position where it can be struck or kicked by the player again, with the cycle repeating for as long as the player wishes to continue. The invention herein is of improvements to this apparatus, such that service life of the tether is substantially extended. One aspect of the invention comprises providing a unique flat triangular structure for the ball positioner such that the tether cord prior to entering the ball or upon exiting from the ball is disposed in straight lines to the points at which the ends of the cord are attached to the pole, such that previously debilitating stresses in the cord are eliminated, thus extending the life of the cord.

Further, because the improved ball positioner of the present invention maintains the cord in straight line configuration, the cord material is not restricted to fabric materials which are easily frayed and broken in use. Thus another aspect of the present invention is that the cord is a flexible metal strand, preferably made of steel or aluminum wire. It is also preferred that the wire be sheathed commonly with an elastomeric or polymeric sheathing material, to protect the metal strand from ambient weather such as rain.

Yet another aspect of the present invention is the construction of the flat triangular ball positioner. It may be made from a flexible, tough elastomeric material that can absorb direct strikes when a batter or kicker misses the ball in a practice session, and which can also absorb the rapid and abrupt changes in direction and motion as the tether wraps and unwraps around the pole in response to striking of the ball. More preferably, however, the positioner will be made of a flexible, strong fabric material, commonly a web material of the type used for heavy-duty belting, outdoor fabric products and the like.

Yet another aspect of the invention is that provision is made for the cord to traverse through the ball in a direction perpendicular to the path of the striking device so that the cord reverses direction in a loop that is at a point on the ball furthest from the intended impact point of the striking device. This minimizes the adverse effect of a misstrike of the ball. The loop of the cord preferably will be seated in a recess in the ball or an insert can be seated in a recess in the ball and the cord seating in a recess in the insert. This also minimizes the effect of the presence of the loop on the player's striking of the ball in a practice session.

All of these aspects of the invention provide a unique apparatus that is ideally suited for use as a striking practice device for sports such as baseball, softball, soccer, tennis, squash, handball and any other sport in which a ball is batter, kicked, swatter, or otherwise struck, particularly those in which the ball is frequently struck hard.

Therefore, in an embodiment the invention is of a ball striking practice apparatus which comprises a strikable ball mounted on a cord; a pole to which the ball is tethered by the cord; and a ball positioner mounted on the cord; the ball positioner being disposed on the cord between the ball and the pole, and comprising a generally flat triangular resilient and integral member having routing means on two sides thereof to route the cord between the ball and the pole in a substantially straight path; whereby the ball may be repeated struck causing the cord to repeatedly wind around and resile from the pole for extended periods without imparting undue stress within the cord.

In another embodiment the invention is of a ball striking practice apparatus which comprises a strikable ball slidably mounted on a cord; a pole to which the ball is tethered by the cord; a ball positioner slidably mounted on the cord, the ball positioner being disposed on the cord between the ball and the pole, and comprising a generally flat triangular resilient and integral member having routing means on two sides thereof to route the cord between the ball and the pole in a substantially straight path; the cord comprising a flexible metal wire; and the cord having two ends, each end being removably attached to the pole; whereby the ball may be repeated struck causing the cord to repeatedly wind around and resile from the pole for extended periods without imparting undue stress within the cord and the ends of the cord may be movably attached to the pole at different positions dependent upon the nature of the ball and its manner of being struck.

Other embodiments, aspects and details will be evident from the description below.

BRIEF DESCRIPTION OF THE DRAWINGS

FIGS. 6 and 7 are respectively cross-sectional views taken on line 6—6 of FIG. 5 and on line 7—7 of FIG. 6.

DETAILED DESCRIPTION AND PREFERRED EMBODIMENTS

Figure 1:
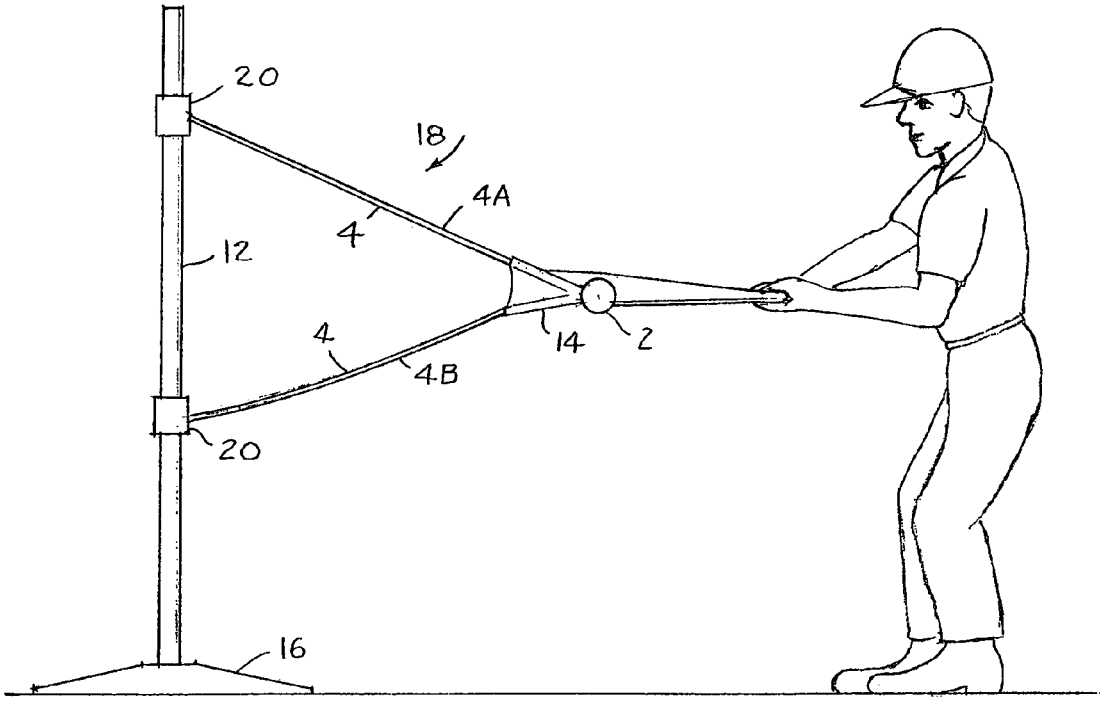
FIG. 1 is an elevation view showing a typical baseball batter swinging at a tethered baseball in a normal manner, with the ball shown in its normal tethered position with the tether structure of the present invention.

The device of the present invention is most easily understood by reference to the Figures of the drawings. The overall system is best illustrated in FIG. 1. The ball 2 may be any types of sports ball which is normally struck in play of a game, usually by kicking, batting or swatting. Typical will be baseballs, softballs, tennis balls, squash balls, handballs, soccer balls (referred to as "footballs" in many countries) and similar balls, or suitable replicas thereof. The ball 2 will be mounted slidably on the cord (strand) 4. For solid balls 2 such as baseballs a pair of holes 6,8 will be drilled through the ball 2 for the cord 4 to pass through, and may have an insert 10 for seating in the ball 2, as will be discussed in more detail below. Where the ball 2 is inflated with air, as with a soccer ball, the holes 6,8 may be in the form of a pair of air impermeable tubes which pass through the ball 2 and are sealed to the ball 2 where they enter or exit the ball surface, to retain the air-tight nature of the ball 2. Alternatively one may construct a solid replica ball of the same size and substantially similar striking characteristics of the air-filled ball, and then mount that solid replica in the manner of a baseball. Thus one could fill a soccer ball with an appropriate polymeric foam to produce a replica soccer ball of correct weight and size and which would respond in a suitable manner to being kicked. The ball 2 may be slid along the cord 4 to become located at the appropriate height, based on where the ends of the tether cord 4 are anchored to the pole 12. The ball 2 will be retained in position by the ball positioner 14, as will be described below.

The vertical pole 12 is mounted on a movable or fixed base 16 and extends to a height appropriate to permit adequate tethering of the ball 2 at the desired ball batting or kicking height. Typically the vertical pole 12 will be on the order of 6–9 ft (2–3 m) in height, depending on the space available for its use and the heights of the players who will be using the device. For the purpose of the present invention of the details of the pole construction are not critical, and the current device may be used with any suitable prior art pole or pole which may hereafter be constructed. To be suitable a pole 12 must have sufficient vertical height for the type of practice and the players involved, and must be capable of being located in a space with sufficient lateral clearance to allow the ball 2 to be properly struck and subsequently recoil after wrapping around the pole 12. The pole 12 must also be mounted or positioned in a location where there is ample room for the batter to stand and take a complete and normal swing at the ball 2. If the pole 12 is mounted on a movable stand 16 the stand must be sufficiently large and heavy to be stable so that the batter's striking of the ball 2 and the resulting torque caused by the ball's wrapping around the pole and then resiling can be resisted and the pole 12 maintained in a vertical orientation without tipping or unduly flexing.

The current invention resides in improvements to the ball's connection with the tether 18 and the ball positioner 14 and to the tether cord 4 and the ball positioner 14 themselves. These are all illustrated starting with FIG. 2. The cord 4 is threaded through one side 24 of the ball positioner 14 and through one channel 6 of the ball 2, and then turned 180° and threaded back through the other channel 8 of the ball and the second side 26 of the ball positioner 14, with the two ends of the cord 4 being anchored to the pole 12 by suitable securing devices 20 such as clamps, adhesive or mounting straps. A preferred securing device 20 comprises a pair of elongated straps to which the respective ends of the cord 4 are bound. The straps have mounted on them strips of opposed hook-and-loop fasteners (e.g., those available under the trademark Velcro®) which will lock together when the straps are wrapped around the pole 12 and the strap ends overlap on each other. To position the ball 2 at the desired height, a portion of the cord 4 is moved through one side 24 or 26 of the ball positioner 14 and ball 2 to produce slack on in the loop 22 at the outside of the ball, the ball 2 is slid on the cord in the appropriate direction to the desired location, and the slack taken out of the loop 22 by retracting the excess cord 4 through the ball 2 and ball positioner 14. It may be necessary to repeat these steps two or more times to reach the desired location.

Figure 3:
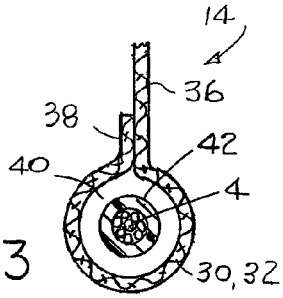
FIG. 3 is a cross-sectional view taken on line 3—3 of FIG. 2.

The ball positioner 14 itself will be made of a resilient material which has sufficient toughness and durability to maintain its integrity despite the repeated stresses of the striking impacts, the abrupt direction reversals and the resiling from being wrapped against the pole 12. The material should not be a rigid or heavy material such as a metal plate, however, since that will adversely affect the resiling motion which presents the ball 2 to the batter or the "feel" of the batter's striking of the ball. Some elastomeric materials will have suitable resiliency and integrity to be useful. Preferred, however, is for the ball positioner 14 to be made of a relatively stiff webbing fabric material 36, commonly of heavy fabric similar to the fabrics often used for belting, backpacks and other fabric articles which must withstand rigorous use. The edges of the two sides 24, 26 of the ball positioner 14 will be turned over to form channels 30, 32 as illustrated in FIG. 3, through which the tether cord 4 will pass. The seams 38 formed by turning over the edge of the fabric 36 may be held in place by stitching, adhesive or other known securing means. Depending on the material used, such other means may include heat sealing or RF sealing. It will be recognized that the seams 38 must be well secured since each time the ball 2 is hit, and each time the cord 4 wraps around the pole and resiles, the forces generated will impart stresses to the fabric 36 and the legs 4A, 4B of the cord. The channels 30, 32 must remain intact and the seams 38 must not be susceptible to parting, or the ball positioner 14 will become unusable. As illustrated in FIG. 3, the internal diameter of the seamed channels 30, 32 must be slightly greater than the outer diameter of the tether cord 4, to allow the cord 4 to move slightly within the channels 30, 32 to minimize the stresses on both the cord 4 and the ball positioner 14 when the ball 2 is struck and the cord 4 is wrapped around the pole. The amount of the clearance between the inside of the channel wall and the outside of the cord will be kept small, however, since excessive flexing of either the cord or the fabric of the channel can also be detrimental to the service life of the device.

The ball positioner 14 is formed in the shape of a flat triangle with the sides 24, 26 of the triangle being aligned in a V-shape such that the each leg 4A, 4B of the tether cord 4 exits from the base 28 of the ball positioner 14 in substantially the same line that it maintained as it passed through the seamed passage 30, 32 on the sides of the ball positioner 14. The tether cord 4 will therefore be bent only at the apex 34 of the ball positioner 14 where the cord 4 enters its passage 6, 8 through the ball 2, and not at the base 28 of the ball positioner 14 where it exits toward the tether connections 20 on the pole. Having each leg 4A, 4B of the cord 4 exit in a straight line significantly reduces the stresses on the cord 4 when the ball 2 is hit. This is a distinct departure from the prior art, in which the two legs of the tether cord have passed through the ball positioner in a parallel alignment such that upon exiting at the base of the ball conditioner both legs of the cord immediately had to be bent away from each other to extend to be the tether connections the pole.

The tether cord 4 used is also different from that of the prior art cords. The prior art did not considered that a flexible metal cable could be used as the tether cord. We have discovered, however, that a flexible steel or aluminum wire or cable can be used if it is covered with a protective sheath 42 to minimize abrasion, fraying and bending. This is illustrated in FIG. 3. It will be evident that the central metal cable is made of a braid of individual smaller metal cables as a conventional wire manufacture, and is covered with an elastomeric (rubber) or polymeric (plastic) sheath 42 which protects it from abrasion and also protects the surrounding fabric 36 and ball 2 from being degraded by contact with bare metal. The polymeric or elastomeric coated cable can be any flexible gauge of steel or aluminum (steel is preferred) which will have the ability to wrap rapidly around the pole 12 and then resile out for a second batting stroke. The cable/cord 4 must be sufficiently flexible and resilient to be able to be wrapped and unwrapped around the pole 12 a large number of times without degrading and breaking. Typically a steel wire of light gauge will be suitable; those skilled in the art can readily select an appropriate wire. It is possible that other metals could be used (such as copper) but those are generally either too soft or too expensive to be practical.

Figure 2:
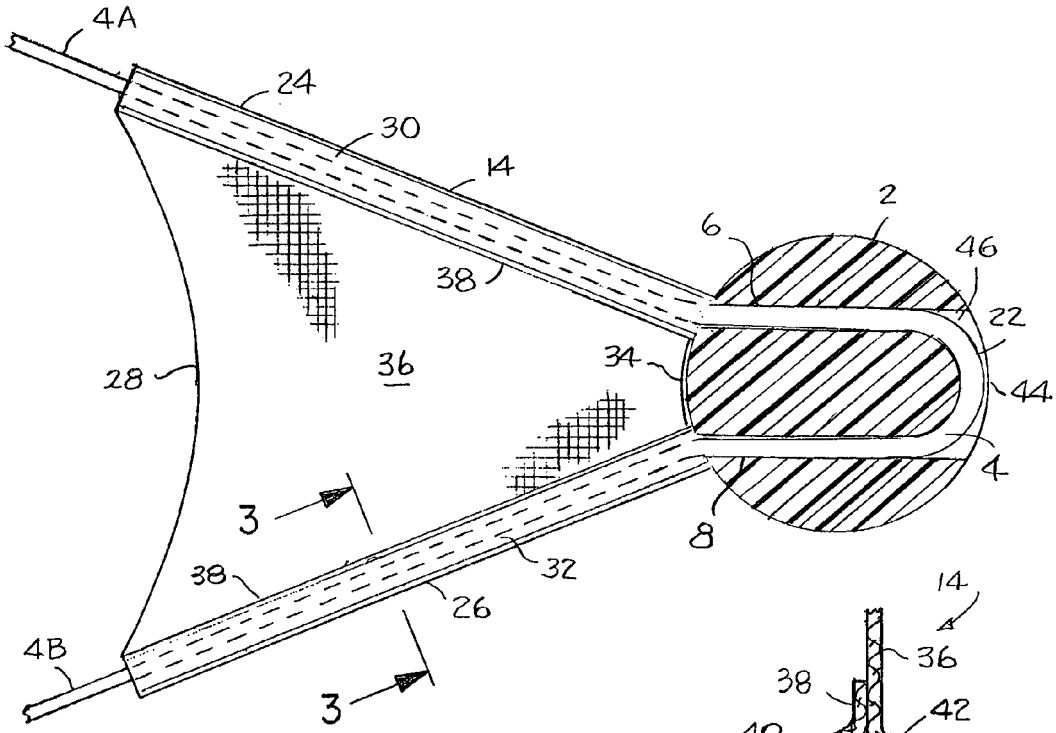
FIG. 2 is a side elevation view of the ball, tether connection to the ball and ball positioner of the present invention, with the ball in cross-section, including illustrating passage of the tether cord through the ball.

The cord 4 will be a continuous strand which runs from one tether anchor 20 to the other and passes through the ball 2 at the cord's central point. The passage through the ball without any insert is illustrated in FIG. 2 and with an insert in FIGS. 4–7. Two parallel holes 6, 8 are drilled through the ball 2 with just enough clearance to allow the sheathed cord 4 to pass through. Adjacent to the outermost or distal point 44 of the ball 2 the cord 4 forms a reverse 180° turn loop 22 in a recess 46 which is aligned at its ends with the holes 6,8 and has a smooth curve to guide the cord 4 in that reverse turn. Alternatively there may be an insert 10 recessed in the ball 2 and the cord 4 is turned around a guide channel 48 in the insert. The appearance to the batter therefore is essentially of a continuous ball without any external cords protruding from it in the zone where the bat's impact will occur. The protrusion of the cord only at the point 44 on the ball entirely outside the batter's striking area is also in direct contrast with prior art devices. In those devices a cord entered the ball from opposite sides and was a clear impediment to hitting the ball cleanly and correctly. While the prior art products had the cord entering and leaving the ball from the top and bottom (as illustrated in the patents mentioned above) such that one might think that they would not have the potential to be struck by a bat or be kicked, it is not possible to control the motion of the ball 2 after the first hit and the subsequent resiling from being wrapped around the pole 12, and it is common for the ball 2 to twist in motion so that the batter on a subsequent swing will hit the cords protruding from the ball rather then the ball itself. Thus many misstrikes were not the fault of the batter but rather the result of the ball having changed orientation as the tether resiled from the pole. In the present invention that problem has been solved since the cord 4 does not appear on any part of the ball 2 in the line of the player's view but only protrudes from the point 44 on the ball 2 most distal from the pole 12, which is also the point which is one of the most difficult for even a novice batter to hit. Thus the batter striking the ball as it resiles from the pole can be confident of hitting the ball itself and not having a significant risk of misstriking the protruding cord. Thus not only does the batter have a better practice experience since he or she is continually hitting the ball itself and not misstriking the cord, but it also prevents misstrikes from causing the ball to fly off in the wrong direction or resile in a manner which might end up striking the hitter or striking the bat.

Figure 4:
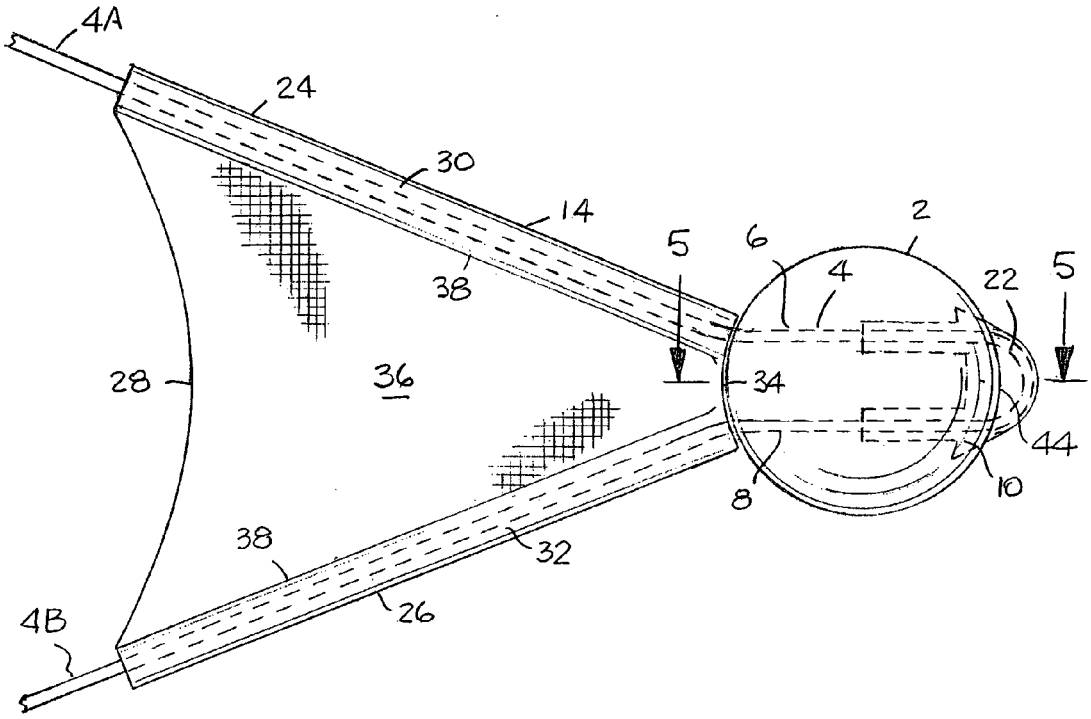
FIG. 4 is a view similar to that of FIG. 2, but including illustration of an insert in the ball over which the tether cord is turned.
Figure 5:
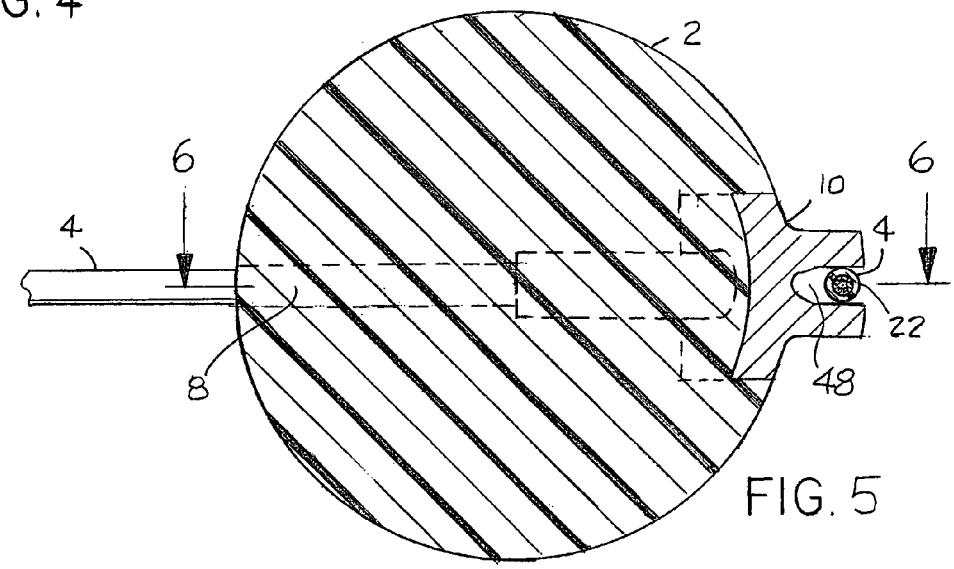
FIGS. 5, 6 and 7 are cross-sectional views of the ball showing three views of the tether connection to the ball.
Figure 6:
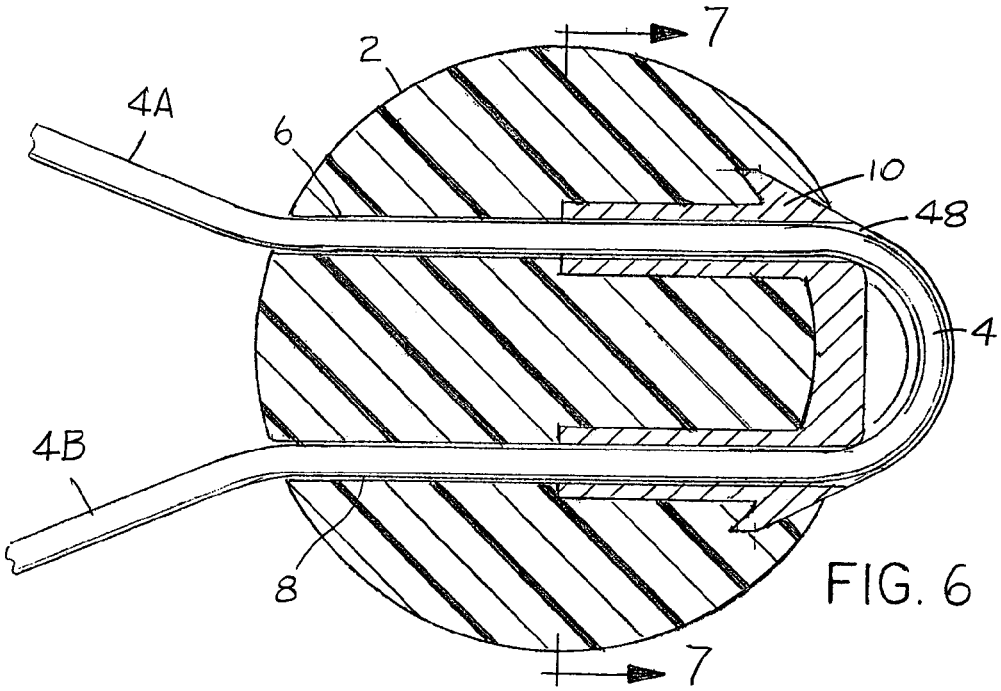
Figure 7:
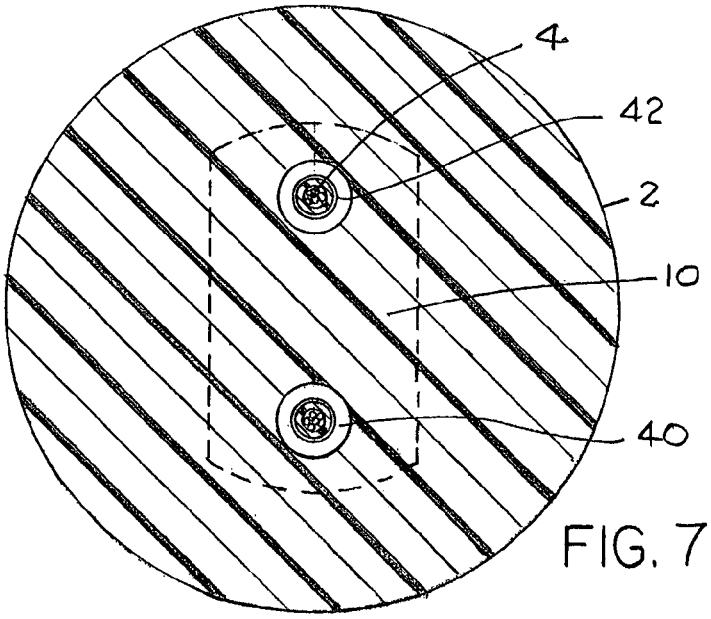

Preferably the recess 46 cut into the ball will be deep enough and configured so that when the cord 4 is looped through the ball as illustrated in FIG. 2, the cord 4 will not protrude beyond the surface of the ball. Although the risk of the batter hitting the cord on a swing rather than hitting the ball is minimized by the position of the cord loop 22 at the point 44 of the ball 90° away from the intended point of impact of the bat or kick. It is acceptable if the loop 22 of the cord 4 does protrude, which it may especially when the insert 10 is present as shown in FIGS. 4 and 6 or the ball is small (e.g., a handball) but it should not protrude more than a modest amount.

In use the player starts by holding the ball 2 and extending the tether 18 so that the ball 2 is at or close to the farthest point radially from the pole 12 that it can reach. The player then throws the ball 2 laterally in the horizontal plane in which the repeated batting, kicking, etc. is to occur. The tether cord 4 causes the ball to spiral inward as the tether wraps around the pole 12. When the tether 18 is fully wrapped onto the pole 12, its momentum causes it to reverse direction, resile and unwrap spirally with a speed only slightly diminished from the speed at which it spiraled inward. By correct timing of his/her swing or kick, the player strikes the ball 2 as the tether cord 4 becomes essentially fully unwrapped and extended and the ball 2 reaches its outmost radial position. This causes the ball 2 to again reverse direction and spiral inwardly at high speed, with the process being repeated as long as the player continues to strike the ball 2 at the end of each outward spiral. If the player should misstrike the ball 2 on any given kick or batting swing, the resulting motion of the ball will not be in the desired horizontal plane and the tether 18 will not effectively wrap around the pole and resile for the player's next kick or swing. The player must then stop the ball 2 and restart the process by again throwing the ball 2 in the horizontal plane and correctly hitting the ball 2 as it next resiles. It will be evident that as the player's proficiency improves, the ball may be regularly and repeatedly struck so that an extended and continuous practice session will result.

The effect of the present improved device is to allow such desirable practice sessions to be repeated many times without having to stop sessions to replace failed components of the device. This is valuable to both proficient and novice players, since each can concentrate on extended sessions of the appropriate levels of practice without being concerned that the repeated striking of the ball is causing undue fatigue in and premature failure of the equipment.

It will be evident that there are numerous embodiments of the present invention which, while not expressly set forth above, are clearly within the scope and spirit of the inventive concept. The description above is therefore to be considered exemplary only, and the scope of the invention is to be limited solely by the appended claims.

What is claimed is:

1. A ball striking practice apparatus which comprises:

a strikable ball mounted on a cord;

a pole to which said ball is tethered by said cord; and a ball positioner mounted on said cord;

said ball positioner being disposed on said cord between said ball and said pole, and comprising a generally flat triangular resilient and integral member having routing means on two sides thereof to route said cord between said ball and said pole in a substantially straight path;

whereby said ball may be repeated struck causing said cord to repeatedly wind around and resile from said pole for extended periods without imparting undue stress within said cord.

2. Apparatus as in claim 1 wherein said cord comprises a flexible metal strand.

3. Apparatus as in claim 2 wherein said metal strand comprises a steel or aluminum strand.

4. Apparatus as in claim 1 wherein said metal strand is sheathed.

5. Apparatus as in claim 4 wherein said sheath comprises a polymer or elastomeric material.

6. Apparatus as in claim 1 wherein said sheath extends over substantially an entire length of said metal strand.

7. Apparatus as in claim 1 comprising a pair of said routing means on said member, each said routing means comprising a tubular channel formed along an edge of said member with one end thereof disposed adjacent said ball.

8. Apparatus as in claim 7 further comprising a pair of said tubular channels, disposed on adjacent edges of said member with one end of each channel disposed adjacent said ball.

9. Apparatus as claim 8 wherein said member comprises an elastomeric material or a fabric web.

10. Apparatus as in claim 9 wherein said channel comprises the hollow elongated interior of a rolled edge of said member.

11. Apparatus as in claim 7 wherein said ball and said ball positioner are both slidable along said cord.

12. Apparatus as in claim 11 wherein said cord traverses sequentially through one said routing, through said ball, and through a second said routing, said cord being aligned in said substantially straight line up to entering said ball and from exiting said ball.

13. Apparatus as in claim 1 further comprising said cord traversing through said ball twice and having a loop between traverses.

14. Apparatus as in claim 13 wherein said loop encompasses 180° between said traverses.

15. Apparatus as in claim 13 further comprising a recess in said ball between traverses and said loop being at least partially seated in said recess.

16. Apparatus as in claim 15 wherein said loop is fully seated in said recess.

17. Apparatus as in claim 16 wherein when seated fully in said recess said loop does not protrude beyond the surface of the ball.

18. Apparatus as in claim 13 further comprising a recess in said ball between traverses and an insert seated in said recess, said loop being at least partially seated in said insert.

19. Apparatus as in claim 18 wherein said loop is fully seated in said insert.

20. Apparatus as in claim 1 wherein said ball comprises a baseball, softball, soccer ball, tennis ball, squash ball, handball or other strikable ball.

21. A ball striking practice apparatus which comprises:

a strikable ball slidably mounted on a cord;

a pole to which said ball is tethered by said cord;

a ball positioner slidably mounted on said cord, said ball positioner being disposed on said cord between said ball and said pole, and comprising a generally flat triangular resilient and integral member having routing means on two sides thereof to route said cord between said ball and said pole in a substantially straight path;

said cord comprising a flexible metal wire; and said cord having two ends, each end being removably attached to said pole;

whereby said ball may be repeated struck causing said cord to repeatedly wind around and resile from said pole for extended periods without imparting undue stress within said cord and said ends of said cord may be movably attached to said pole at different positions dependent upon the nature of said ball and its manner of being struck.

22. Apparatus as in claim 21 wherein said metal strand comprises a steel or aluminum strand.

23. Apparatus as in claim 22 wherein said metal strand is sheathed with a polymer or elastomeric material over substantially its entire length.

24. Apparatus as in claim 21 comprising a pair of said routing means on said member, each said routing means comprising a tubular channel formed along an edge of said member with one end thereof disposed adjacent said ball.

25. Apparatus as claim 21 wherein said member comprises an elastomeric material or a fabric web.

26. Apparatus as in claim 25 wherein said fabric web comprises a belting fabric.

27. Apparatus as in claim 21 wherein said cord traverses sequentially through one said routing, through said ball, and through a second said mounting, said cord being aligned in said substantially straight line up to entering said ball and from exiting said ball.

28. Apparatus as in claim 27 further comprising said cord traversing through said ball twice and having a loop encompassing 180° between traverses.

29. Apparatus as in claim 28 further comprising a recess in said ball between traverses and said loop being partially or fully seated in said recess.

30. Apparatus as in claim 28 further comprising a recess in said ball between traverses and an insert seated in said recess, said loop being partially or fully seated in said insert.

31. Apparatus as in claim 21 wherein said ball comprises a baseball, softball, soccer ball, tennis ball, squash ball, handball or other strikable ball.

* * * * *